US005938136A

United States Patent [19]

Miller

[11] Patent Number: 5,938,136

[45] Date of Patent: Aug. 17, 1999

[54] SHUTTER CONTROL STRAP RECOILER

[76] Inventor: James V. Miller, 893 Maryknoll Cir., Glen Ellyn, Ill. 60137

[21] Appl. No.: 09/169,419

[22] Filed: Oct. 9, 1998

[51] Int. Cl.[6] ..... B65H 75/48; E06B 9/56

[52] U.S. Cl. ..... 242/375.1; 242/379.2; 242/381.1; 160/319

[58] Field of Search ..... 242/375.1, 379, 242/379.2, 381.1; 160/307, 308, 309, 314, 319

[56] References Cited

U.S. PATENT DOCUMENTS

| | | | |
|---|---|---|---|
| 315,029 | 4/1885 | Hilditch | 160/314 |
| 2,767,426 | 10/1956 | Grupp | 242/375.1 |
| 4,300,732 | 11/1981 | Gaeta | 242/379.2 |
| 4,492,261 | 1/1985 | Chong | 160/319 |
| 4,529,146 | 7/1985 | Nederman | 242/379.2 |
| 4,722,495 | 2/1988 | Meredith | 242/381.1 |
| 4,846,248 | 7/1989 | Sonderby | 242/379.2 |
| 4,883,109 | 11/1989 | Sonderby | 160/319 |
| 5,575,322 | 11/1996 | Miller | 160/133 |

*Primary Examiner*—John P. Darling
*Attorney, Agent, or Firm*—Marshall, O'Toole, Gerstein, Murray & Borun

[57] ABSTRACT

A recoiler for rolling shutter assemblies that includes a protective cover that reduces the risk of accidentally releasing the strap and, consequently, the shutter curtain. The protective cover is disposed over the locking mechanism to prevent the inadvertent unlocking of the mechanism either by intentionally forcing the mechanism to the unlocked position or the accidentally engaging the mechanism with another object. Additionally, the recoiler facilitates adjustment of the tension in the torsion spring of the take-up roll without the necessity of removing the take-up roll assembly from the strap recoiler housing. The recoiler provides access to the shaft so that a torque may be applied to rotate the shaft to increase and/or decrease the tension in the torsion spring.

12 Claims, 9 Drawing Sheets

SHUTTER CONTROL STRAP RECOILER

BACKGROUND OF THE INVENTION

The present invention is directed to a rolling protective shutter assembly which has a protective shutter, for covering a window or door opening, that may be rolled up into a shutter housing when not in use.

Rolling protective shutters are conventional and are used to provide protection against extreme weather conditions and to deter theft, for example. One such rolling protective shutter is disclosed in U.S. Pat. No. 5,575,322, issued to Miller on Nov. 19, 1996, entitled "Rolling Protective Shutters," which is hereby expressly incorporated by reference herein. As shown in FIGS. 1 and 2 of that patent, the Miller shutter is composed of a plurality of individual slats and a plurality of hinges interconnecting the slats. Each of the slats has a pair of end portions, and the shutter assembly further includes a pair of shutter tracks and means for rolling the shutter from an extended position in which the end portions of the slats are disposed in the shutter tracks to a retracted position in which the shutter is rolled up on a shutter support member.

The shutter assembly of the Miller patent uses a gearbox and hand crank as the means for rolling the shutter between the extended position and the retracted position. In other installations, the gearbox and hand crank are replaced by a pulley and control strap that control the rolling and unrolling of the shutter. In these installations, the pulley is attached to the shutter support member, and the strap is connected between the pulley and a strap recoiler mounted to one of the shutter tracks or to the wall surrounding the opening. The strap recoiler contains a take-up roll upon which the excess strap is stored and a locking mechanism with a brake tab that locks the strap in place when the strap is pulled tight between the pulley and the strap recoiler.

The locking mechanism of the strap recoiler is configured to facilitate retraction and deployment of the strap to roll and unroll the shutter. To roll the shutter to the retracted position, the strap is pulled outwardly away from the shutter track and the opening and downwardly toward the strap recoiler. As the strap is pulled outwardly, the locking mechanism releases the strap and allows the force of a torsion spring within the take-up roll to wind the excess strap onto the take-up roll. At the same time, the control strap is unrolled from the pulley, thereby rolling the shutter onto the shutter support member. When the strap is released, the weight of the shutter rotates the pulley and pulls the strap tight between the pulley and the strap recoiler, thereby locking the locking mechanism.

To unroll the shutter to the deployed position, the strap is pulled outwardly away from the shutter track and the opening and upwardly toward the pulley and shutter housing. As the strap is pulled outwardly, the locking mechanism releases the strap and allows the strap to unwind from the take-up roll. At the same time, the control strap is rolled onto the pulley as the shutter support member rotates due to the weight of the shutter. When the strap is released, the weight of the shutter and the tension in the torsion spring pull the strap tight between the pulley and the strap recoiler, thereby locking the locking mechanism.

In previous strap recoilers, the strap and the brake tab are accessible through an opening in the housing of the strap recoiler. The locking mechanism may be unlocked by depressing the brake tab and releasing the restraining force on the strap. If the shutter is in the retracted position, the weight of the shutter can cause the shutter curtain to unroll and crash down, resulting in damage to the shutter and injury to body parts disposed within the opening. For example, in most pharmacy installations, the strap and recoiler are located on the pharmacy side of the opening for security reasons. A curious customer intrigued by the strap recoiler may reach across the opening and depress the brake tab, thereby causing the shutter to come crashing down on the customer's arm and resulting in injury to the customer and potential liability for the pharmacy. Therefore, a need exists for an improved shutter control strap recoiler that allows deployment of the control strap while preventing inadvertent release of the locking mechanism for the strap.

Previously known strap recoilers do not provide easy access for adjusting the tension in the torsion spring of the take-up roll. The tension in the torsion spring is set during the installation of the shutter assembly. However, after repeated loading and unloading of the spring as the shutter is rolled and unrolled, the metal in the spring may fatigue, resulting in insufficient torque to roll the strap onto the take-up roll. In the presently known strap recoilers, the tension in the torsion spring is adjusted by opening the recoiler housing and/or the shutter housing, and typically necessitates a relatively expensive service call for a simple adjustment. Therefore, a need exists for an improved strap recoiler that facilitates adjustment of the spring tension in the take-up roll without disassembling the recoiler housing and/or the shutter housing.

SUMMARY OF THE INVENTION

The present invention is directed to an improved strap recoiler for rolling shutter assemblies that includes a protective cover that reduces the risk of accidentally releasing the strap and, consequently, the shutter curtain. The protective cover is disposed over the locking mechanism to prevent the inadvertent unlocking of the mechanism either by intentionally forcing the mechanism to the unlocked position or the accidentally engaging the mechanism with another object. Additionally, the present invention is directed to an improved strap recoiler that facilitates adjustment of the tension in the torsion spring of the take-up roll without the necessity of removing the take-up roll assembly from the strap recoiler housing. The recoiler provides access to the shaft so that a torque may be applied to rotate the shaft to increase and/or decrease the tension in the torsion spring.

In one aspect, the present invention is directed to a strap recoiler for a rolling shutter assembly having a housing with an opening in the top wall, and a take-up roll rotatably mounted within the housing. The take-up roll includes a torsion spring that biases the take-up roll in a first direction. The strap recoiler further includes a strap having a first end coupled to the take-up roll and a second end extending through the opening in the housing, with the strap rolling up on the take-up roll when the take-up roll rotates in the first direction and unrolling from the take-up roll when the take-up roll rotates in a second direction. A locking mechanism is disposed within the housing proximate the opening. The mechanism has a locked position wherein the strap is engaged by the locking mechanism to prevent it from unrolling from the take-up roll and an unlocked position wherein the locking mechanism disengages the strap to allow the strap to unroll from the take-up roll. The strap recoiler further includes a cover disposed over the opening and the locking mechanism. The cover prevents engagement of the locking mechanism so that the locking mechanism is not inadvertently moved from the locked position to the unlocked position.

In another aspect, the present invention is directed to a strap recoiler for a rolling shutter assembly that includes a housing having a first opening on a side wall and a second opening on a top wall. The strap recoiler further includes a shaft disposed within the housing and a take-up roll rotatably mounted to the shaft. The shaft includes a first end that is disposed within the first opening of the housing and engage by the first opening to prevent rotation of the shaft in at least one direction. The strap recoiler further includes a torsion spring having a first end coupled to the take-up roll and a second end coupled to the shaft, and a strap having a first end coupled to the take-up roll and a second end extending out of the second opening of the housing. The torsion spring biases the take-up roll to rotate in a first direction that rolls the strap onto the take-up roll and the strap unrolls from the take-up roll when the take-up roll rotates in a second direction.

The strap recoiler further includes a locking mechanism disposed within the housing proximate the opening. The mechanism has a locked position wherein the strap is engaged by the locking mechanism to prevent it from unrolling from the take-up roll and an unlocked position wherein the locking mechanism disengages the strap to allow the strap to unroll from the take-up roll. The first opening and the first end of the shaft are adapted to allow rotation of the shaft relative to the take-up roll without removing the shaft, the take-up roll and the torsion spring from the housing. In one embodiment, the first opening and the first end of the shaft are configured in a ratchet and pawl relationship such that the first opening permits the shaft to rotate in a direction that increases the tension in the torsion spring and restricts the shaft from rotating in the opposite direction. In another embodiment, the first opening prevents the shaft from rotating in either direction. In this embodiment, the shaft is configured so that application of an axial force to first end of the shaft pushes the first end into the housing and clear of the first opening, thereby permitting rotation of the shaft in either direction. A coil spring may provided to bias the first end of the shaft into the first opening when the axial force is removed from the shaft.

The features and advantages of the invention will be apparent to those of ordinary skill in the art in view of the detailed description of the preferred embodiments, which is made with reference to the drawings, a brief description of which is provided below.

DETAILED DESCRIPTION OF THE PREFERRED EMBODIMENTS

Figure 1:
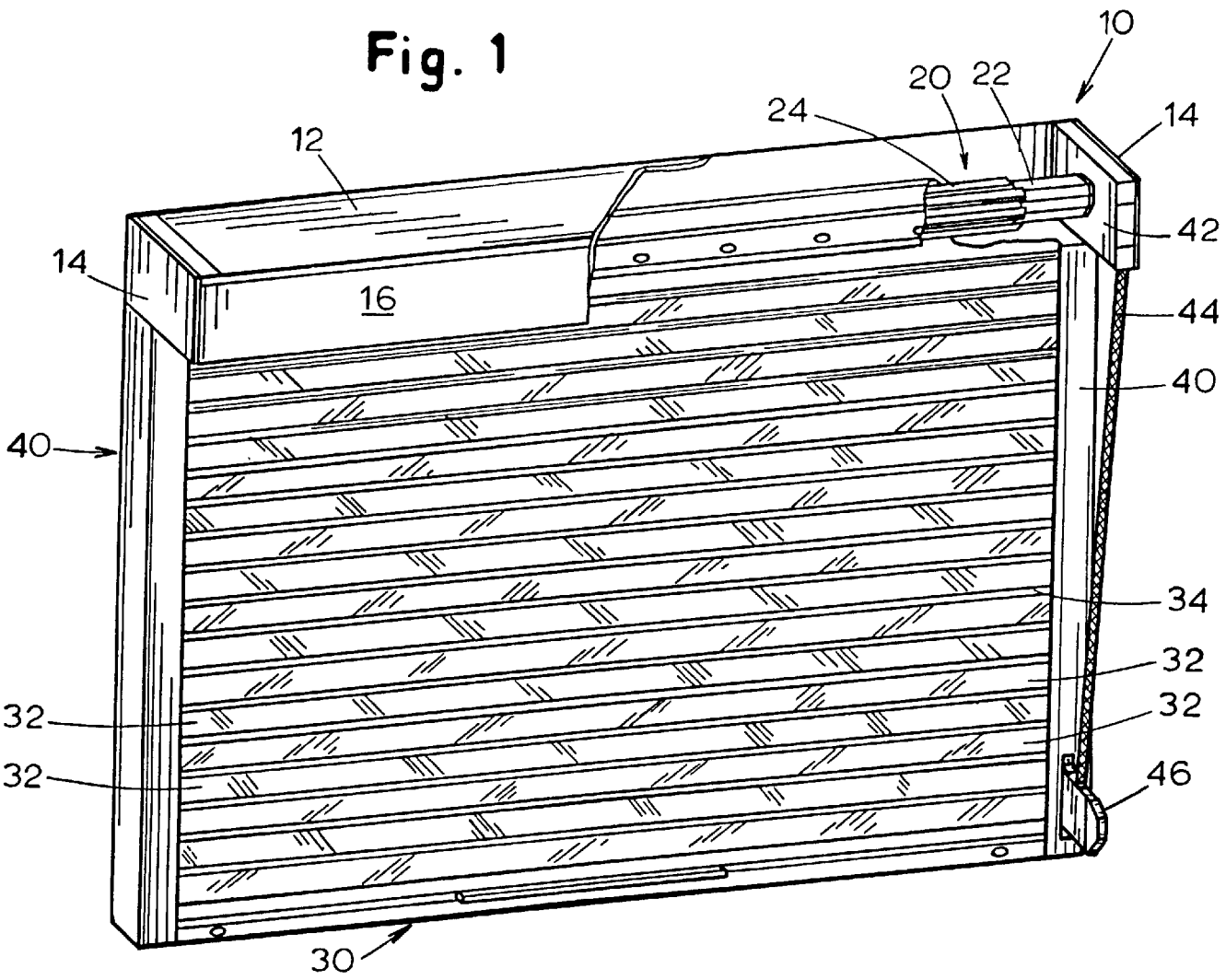
FIG. 1 is a perspective view of a first embodiment of a rolling shutter assembly that can implement the present invention.
Figure 2:
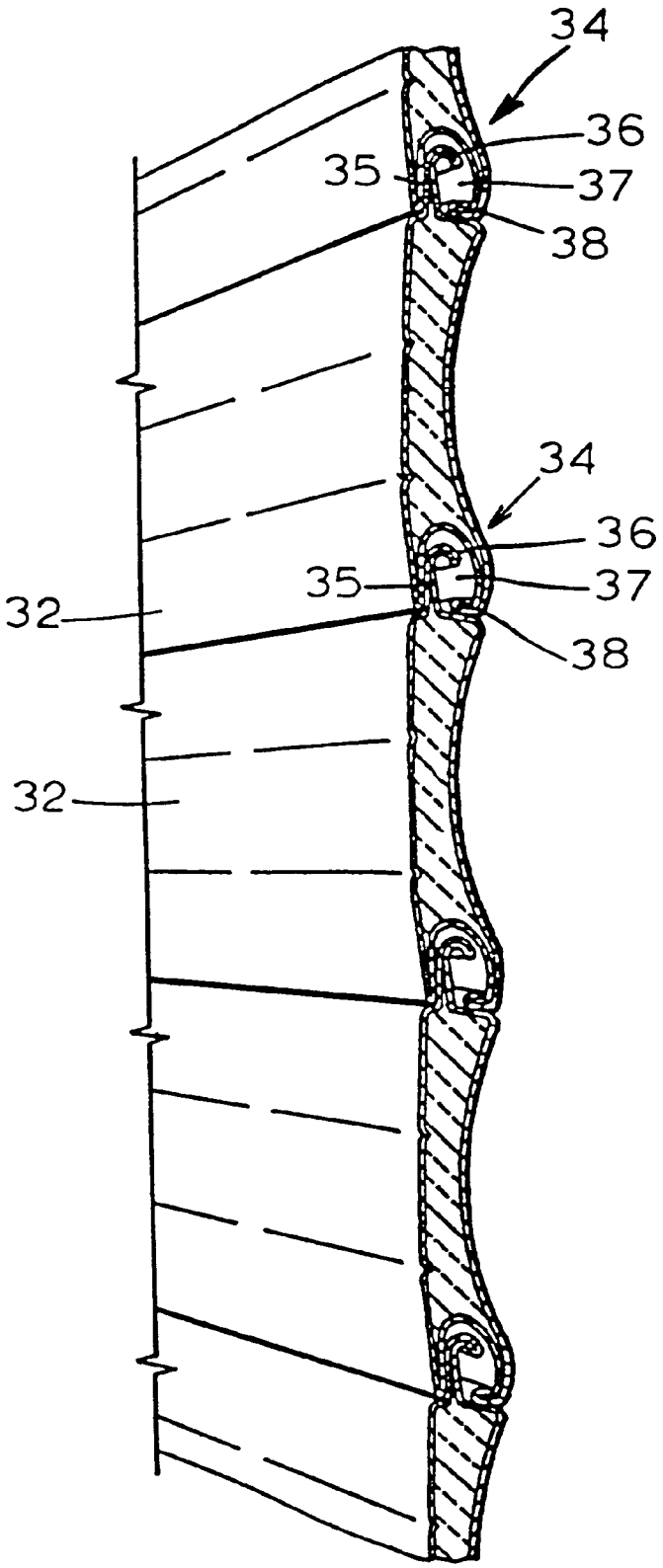
FIG. 2 is a fragmentary perspective view of a portion of the shutter of the shutter assembly of FIG. 1.
Figure 3:
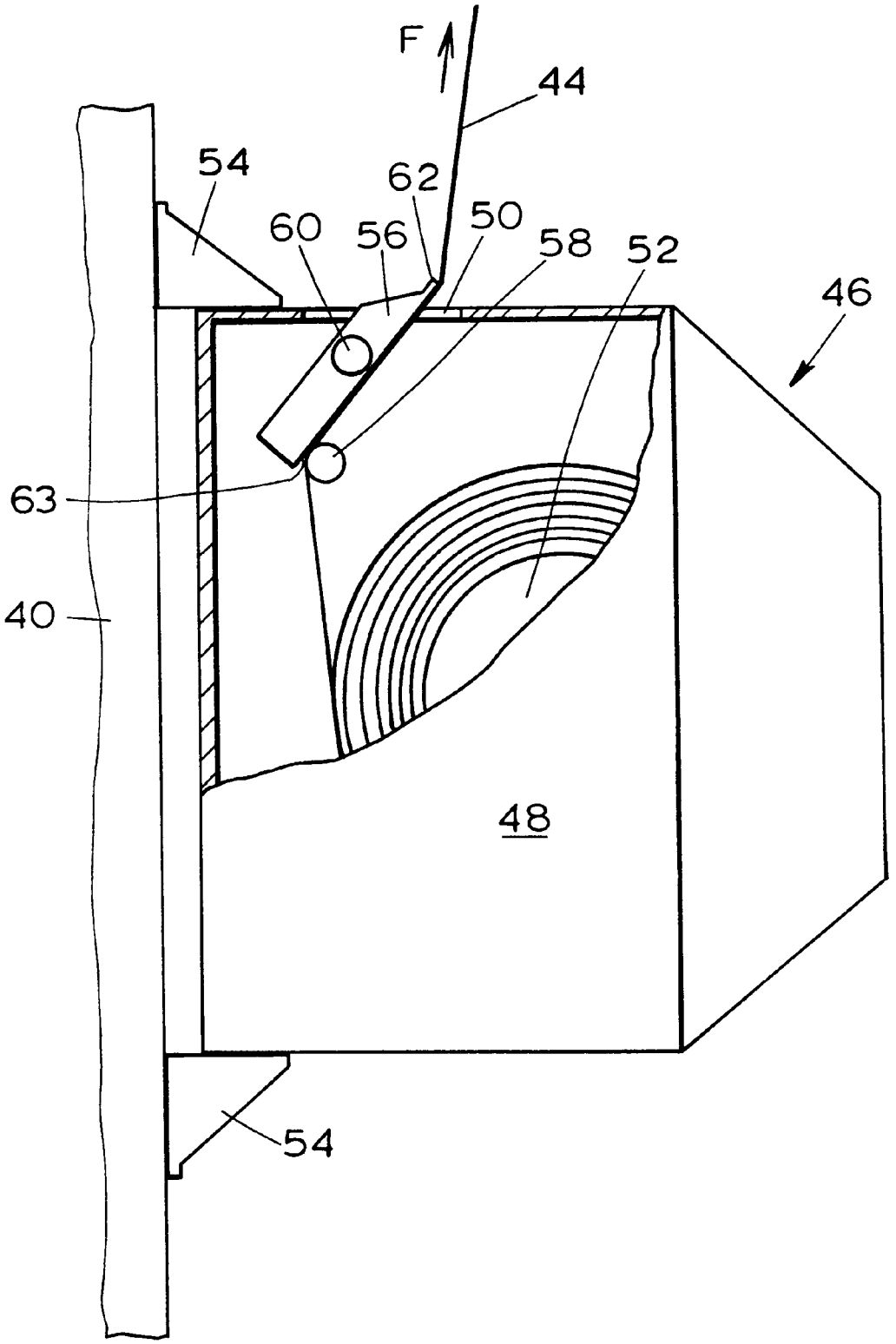
FIG. 3 is a partial cross-sectional side view of the strap recoiler of FIG. 1 in the locked position.

One type of a rolling shutter assembly 10 that may implement the present invention is shown in FIGS. 1–3. Referring to FIG. 1, the shutter assembly 10 has a shutter housing which includes a top wall 12, a pair of side walls 14, and a front wall 16. A shutter support member 20 is mounted for rotation within the shutter housing. The support member 20 includes a generally cylindrical central shaft 22 and a plurality of mounting members 24 fixed to the shaft 22.

The upper end of a rolling shutter 30 is coupled to the mounting members 24. The shutter 30 is composed of a plurality of individual, elongate slats 32. One example of a configuration of slats 32 is illustrated in FIG. 2. The slats 32, each of which is substantially flat, having two substantially planar side portions, and may be composed of steel, are interconnected by a plurality of hinges 34, each of which joins together a pair of adjacent slats 32. Each of the slats 32 includes an upward projection 35 extending longitudinally along the upper edge of the slat 32 and having a rearwardly and downwardly extending hook 36 at the top. Each of the slats 32 further includes a downward facing U-shaped recess 37 extending longitudinally along the lower edge of the slat 32 and having a forward horizontal projection 38 formed on the rear edge of the recess 37. The hook 36 of a lower slat 32 and the recess 37 and projection 38 of an upper slat 32 interlock to form each hinge 34. Other configurations of slats 32 and interconnecting hinges 34 are well known in the art and are contemplated by the inventor as having use with the present invention.

Referring back to FIG. 1, the ends of the slats 32 are disposed within a pair of shutter tracks 40. The shutter assembly 10 has a pulley housing 42 which interconnects the rotatable shaft 22 to one end of a strap 44 via a conventional pulley (not shown). The other end of the strap 44 is attached to a strap recoiler 46. When mounted to protect a window or other opening, the shutter tracks 40 of the shutter assembly 10 are positioned on either side of the opening and the shutter housing is positioned over the top of the opening. Alternatively, in some applications, the side tracks 40 and shutter housing are positioned within the opening.

Figure 4:
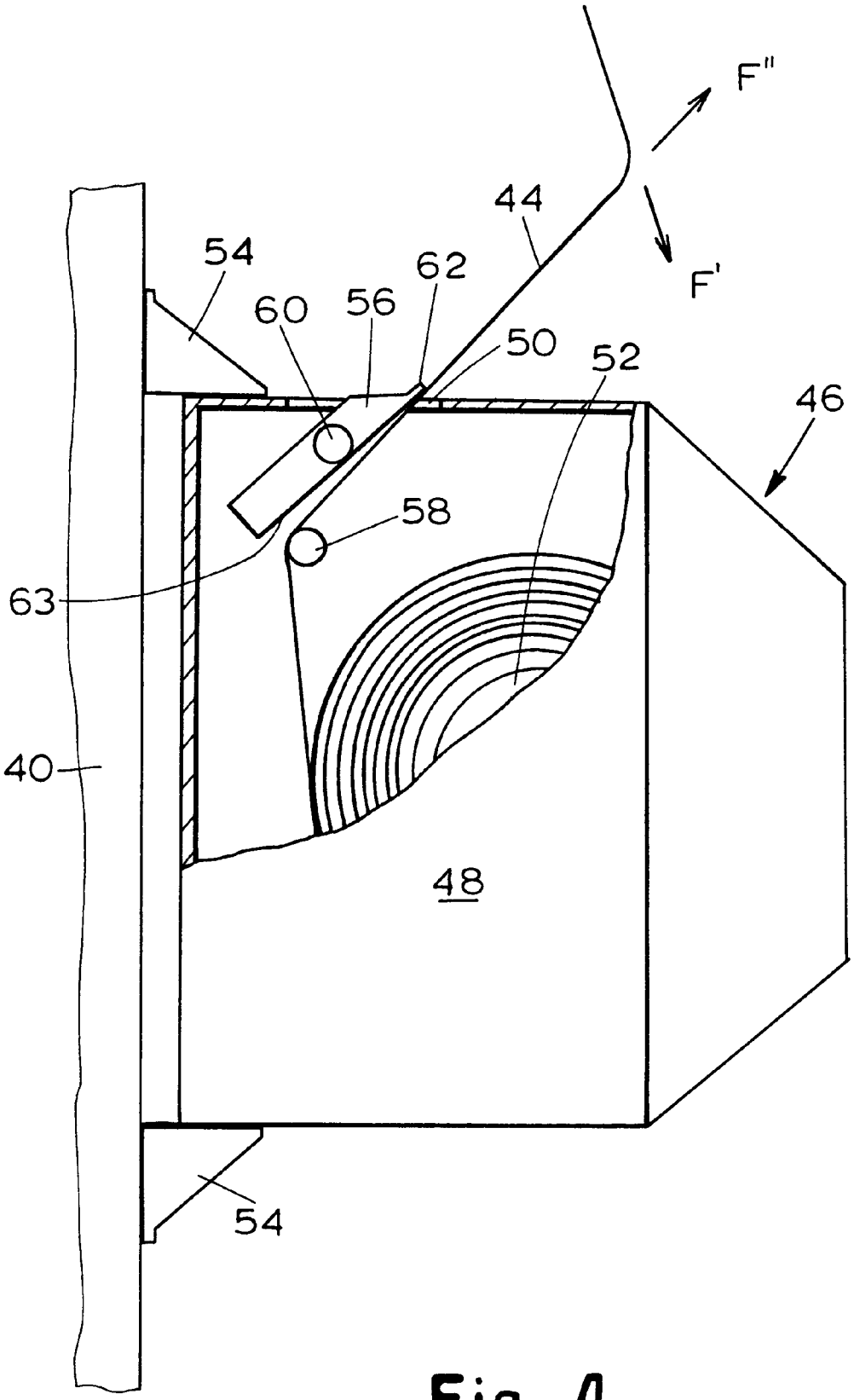
FIG. 4 is a partial cross-sectional side view of the strap recoiler of FIG. 1 in the unlocked position.

The strap recoiler 46 is shown in greater detail in FIGS. 3 and 4. Referring to FIG. 3, the strap 44 enters the housing 48 of the recoiler 46 through an opening 50 in the top. The strap 44 is attached to a take-up roll 52 disposed within the housing 48. The take-up roll 52 is rotatably coupled to the housing 48 by a central shaft (not shown) and includes a torsion spring (not shown) that applies torque that rotates the take-up roll 52 counter-clockwise as shown in FIG. 3. The housing 48 is mounted to the shutter track 40 by a pair of mounting brackets 54 that are pivotally connected to the housing 48. The brackets 54 permit the strap recoiler 46 to rotate from side-to-side if the strap 44 is pulled outwardly at an acute angle with respect to the opening and the wall.

The strap recoiler 46 further includes a locking mechanism formed by a brake tab 56 and a bearing pin 58. The brake tab 56 is pivotally mounted to the housing 48 by a pivot pin 60. The brake tab 56 pivots about the pivot pin 60 between a locked position (FIG. 3) wherein the brake tab 56 bears upon the bearing pin 58, and an unlocked position (FIG. 4) wherein the brake tab 56 does not bear upon the bearing pin 58. When the shutter 30 is partially or fully rolled onto the shutter support member 20, gravity tends to rotate the shutter support member 20 in the direction that unrolls the shutter 30. This results in a force on the strap 44 in the direction of the shutter housing as indicated by the arrow F. The tension on the strap 44 exerts a force on a tip 62 of the brake tab 56 that rotates an engagement surface 63 at the opposite end of the brake tab 56 into engagement with the bearing pin 58. In this position, the frictional force between the engagement surface 63, the bearing pin 58 and the strap 44 is sufficient to retain the strap 44 and prevent the shutter 30 from unrolling.

During normal operation of the shutter assembly 10, the locking mechanism automatically releases the strap 44 when the strap 44 is pulled to raise or lower the shutter 30, as illustrated in FIG. 4. To roll the shutter 30 onto the shutter support member 20, the strap 44 is pulled outwardly away from the shutter track 40 and the opening and downwardly toward the strap recoiler 46, in the general direction of the arrow F'. As the strap 44 is pulled outwardly and downwardly, the upward force exerted on the tip 62 of the brake tab 56 decreases and the brake tab 56 pivots toward the unlocked position. The strap 44 is released and the force of the torsion spring within the take-up roll 52 winds the excess strap 44 onto the take-up roll 52. At the same time, the strap 44 is unrolled from the pulley, thereby rolling the shutter 30 onto the shutter support member 20. When the strap 44 is released, the weight of the shutter 30 rotates the pulley and pulls the strap 44 tight between the pulley and the strap recoiler 46, thereby pivoting the brake tab 56 to the locked position of FIG. 3 and securing the strap 44 to prevent the shutter 30 from unrolling.

To unroll the shutter 30 toward the deployed position, the strap 44 is pulled outwardly away from the shutter track 40 and the opening and upwardly away from the strap recoiler 46, in the general direction of the arrow F". As the strap 44 is pulled outwardly and upwardly, the upward force exerted on the tip 62 of the brake tab 56 decreases and the brake tab 56 pivots toward the unlocked position shown in FIG. 4. The strap 44 is released and the weight of the shutter 30 rotates the shutter support member 20 and the excess strap 44 winds onto the pulley. At the same time, the strap 44 is unrolled from the take-up roll 52, thereby increasing the tension in the torsion spring. When the strap is released, the weight of the shutter 30 and the tension in the torsion spring pull the strap 44 tight between the pulley and the strap recoiler 46, thereby pivoting the brake tab 56 to the locked position of FIG. 3 and securing the strap 44 to prevent the shutter 30 from unrolling.

Figure 5:
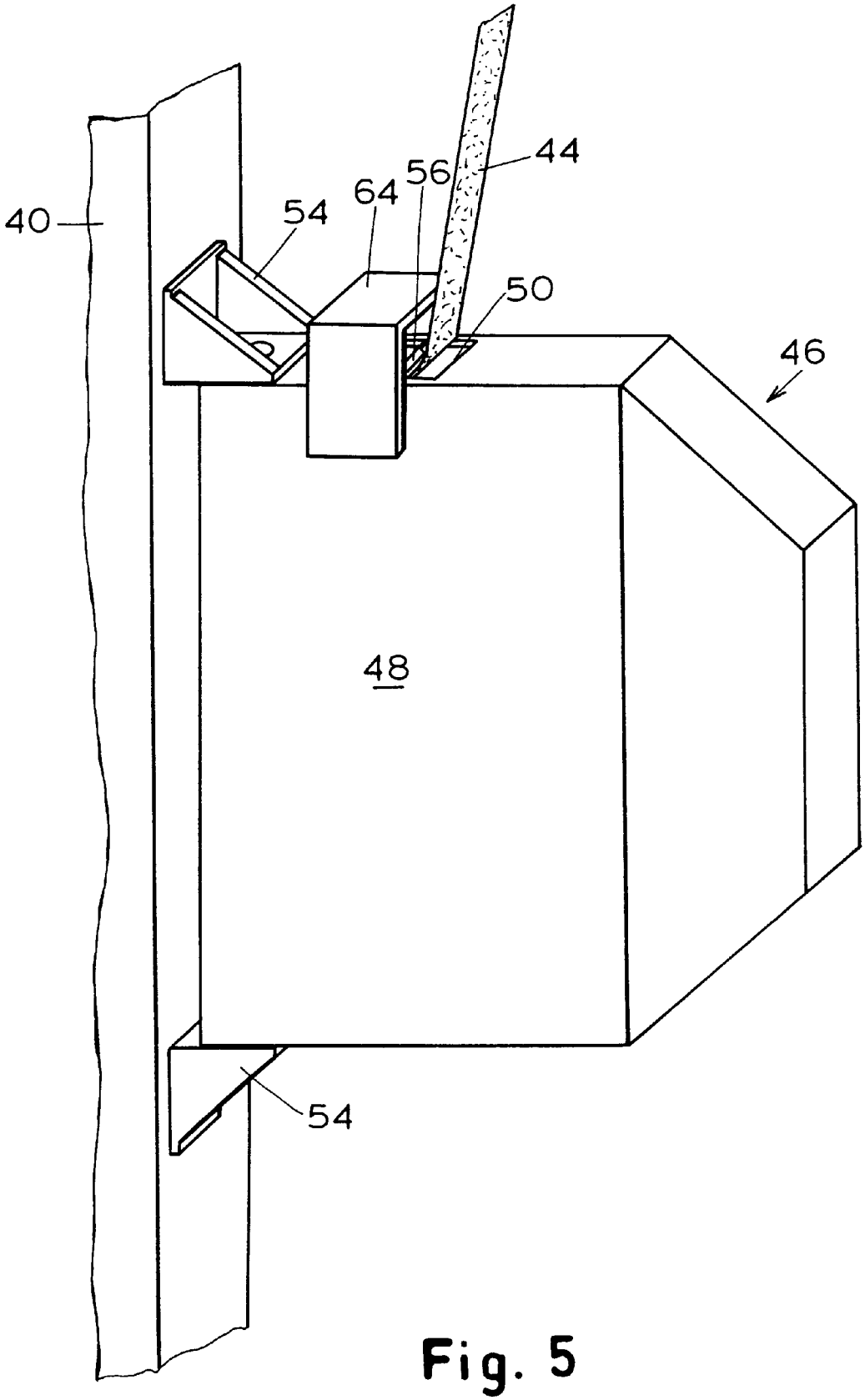
FIG. 5 is an isometric view of a strap recoiler including a protective cover according to the present invention.
Figure 6:
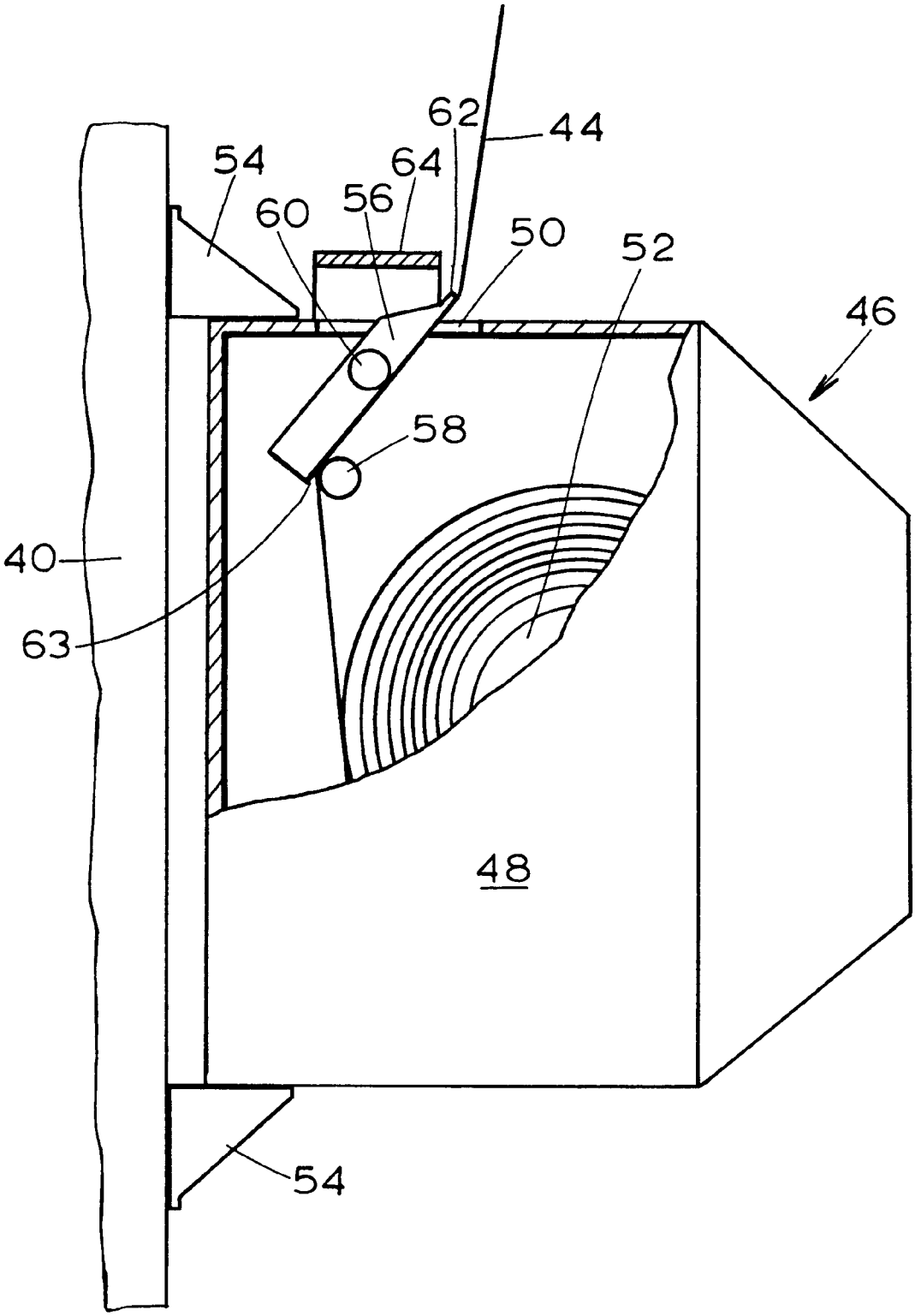
FIG. 6 is a partial cross-sectional side view of the strap recoiler of FIG. 5.

As previously discussed, the strap 44 and the brake tab 56 are accessible through the opening 50 in the housing 48 of the strap recoiler 46. Therefore, when the brake tab 56 is in the locked position, the tip 62 may be depressed, thereby releasing the strap 44 and allowing the shutter 30 to unroll without control. FIGS. 5 and 6 illustrate the strap recoiler 46 including a protective cover 64 for the brake tab 56. As shown in the figures, the protective cover 64 is mounted to the housing 48 proximate the opening 50. The cover 64 encloses substantially the entire opening 50, but does provide sufficient space for the brake tab 56 to pivot between the locked and the unlocked positions. Additionally, the cover 64 leaves sufficient space for the strap 44 to pass in and out of the opening 50 when the shutter 30 is rolled and unrolled.

The cover 64 can be integrally formed along with the housing 48 as a single component of the strap recoiler 46. Alternatively, the cover 64 can be fabricated separately and attached to the housing 48 as a separate step when assembling the strap recoiler 46. In addition, individually fabricated covers 64 can be supplied as add-on components for strap recoilers 46 that have been installed or manufactured previously. The covers 64 can be fastened to any new or existing strap recoiler 46 by any known fastening method, such as with adhesive, screws or detents.

With the cover 64 installed, the opening 50 and brake tab 56 are less visible and, therefore, less intriguing to a curious customer or passer-by. Additionally, the cover 64 protects the brake tab 56 from being inadvertently depressed by an object dropped near the strap recoiler 46 or by a person accidently brushing against the brake tab 56. Although the cover 64 is shown herein as attached to the sides of the housing 48 and spans across the top of the housing 48 above the opening 50, other configurations for providing a cover over the opening 50 and brake tab 56 and for connecting the cover to the housing 48, the bracket 54 and/or the shutter track 40 will be apparent to those of ordinary skill in the art and are contemplated by the inventor as having use with the present invention.

Figure 7:
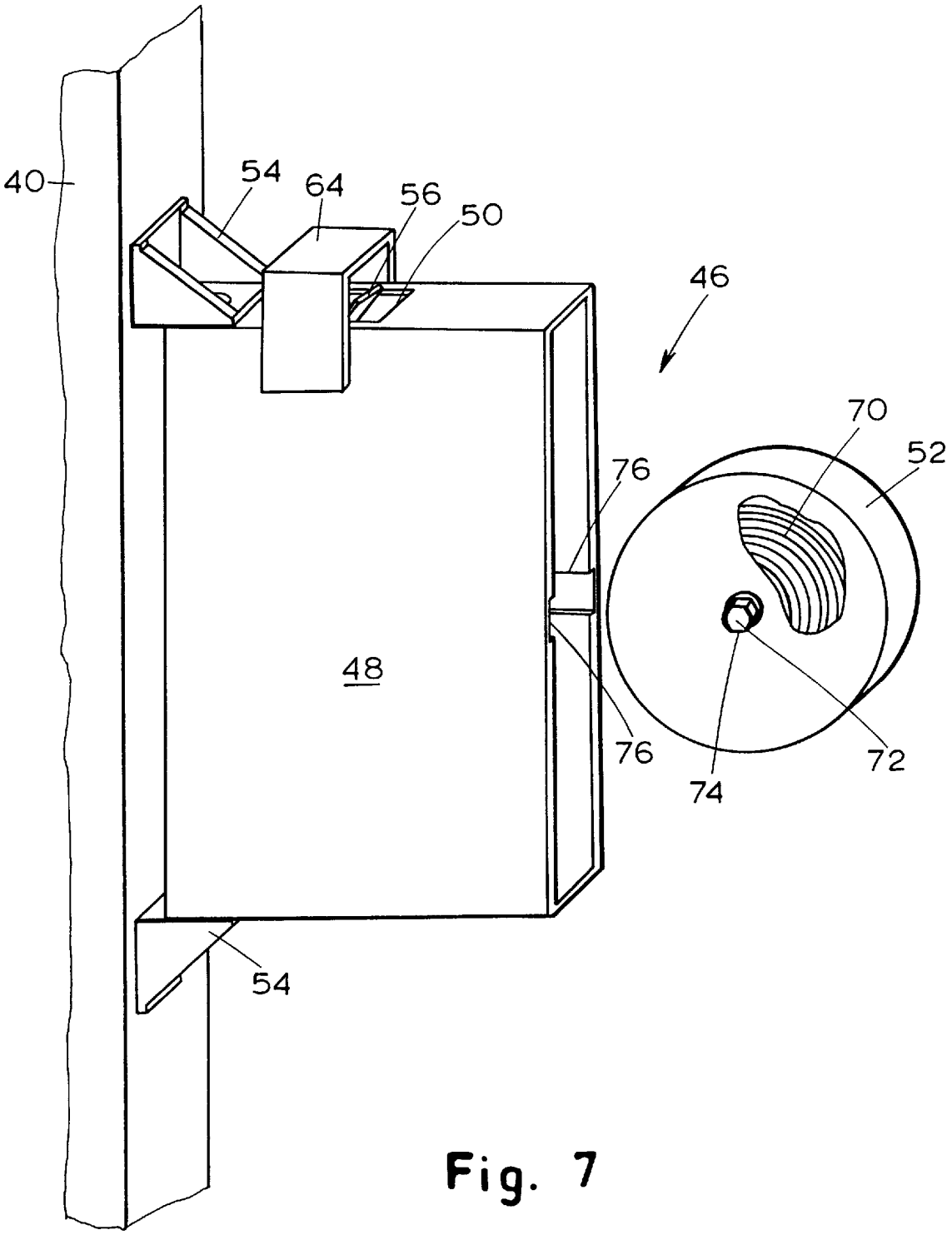
FIG. 7 is an exploded isometric view of the strap recoiler of FIG. 5.

As previously discussed, the take-up roll 52 in the strap recoiler 46 includes a torsion spring that provides torque to roll up the excess strap 44 when the shutter 30 is opened. FIG. 7 illustrates the strap recoiler 46 with the front portion of the housing 48 and the take-up roll 52 removed. The front portion and the strap 44 are omitted from the figure for the sake of clarity, and the take-up roll 52 is shown with a portion of the wall removed to expose a torsion spring 70. The take-up roll 52 includes a central shaft 72 that is rotatable with respect to the take-up roll 52. One end of the torsion spring 70 is connected to the take-up roll 52 and the other end is connected to the shaft 72 such that the tension in the torsion spring 70 increases as the strap 44 is unrolled (clockwise rotation of the roll 52) and decreases as the strap 44 is rolled up (counter-clockwise rotation of the roll 52).

In order for the take-up roll 52 to rotate relative to the shaft 72, the shaft 72 is held stationary within the housing 48. The shaft 72 includes a pair grooves 74 at each end disposed on opposite sides of the shaft 72, and the housing 48 includes internal channels 76 that receive the ends of the shaft 72. When the strap recoiler 46 is assembled, the shaft 72 is oriented so that grooves 74 align with the channels 76 of the housing 48 when the take-up roll 52 is inserted. When the ends of the shaft 72 are disposed in the channels 76, the walls of the channels 76 retain bear upon the grooves 74 to retain the shaft 72 as the take-up roll 52 rotates to roll and unroll the strap 44.

When the take-up roll 52 is disposed within the housing 48, the tension in the torsion spring 70 may be adjusted either by rotating the take-up roll 52 or by varying the amount of the strap 44 that is unrolled from the roll 52. The adjustment is quick and simple during the installation of the shutter assembly 10. However, once the shutter assembly 10 is installed, adjustment of the tension in the torsion spring 70 requires opening the shutter housing and/or the housing 48 of the strap recoiler 46, and detaching the strap 44 from the pulley. Therefore, the present invention provides a strap recoiler that allows adjustment of the tension in a torsion spring without the necessity of disassembling the shutter assembly 10.

Figure 8:
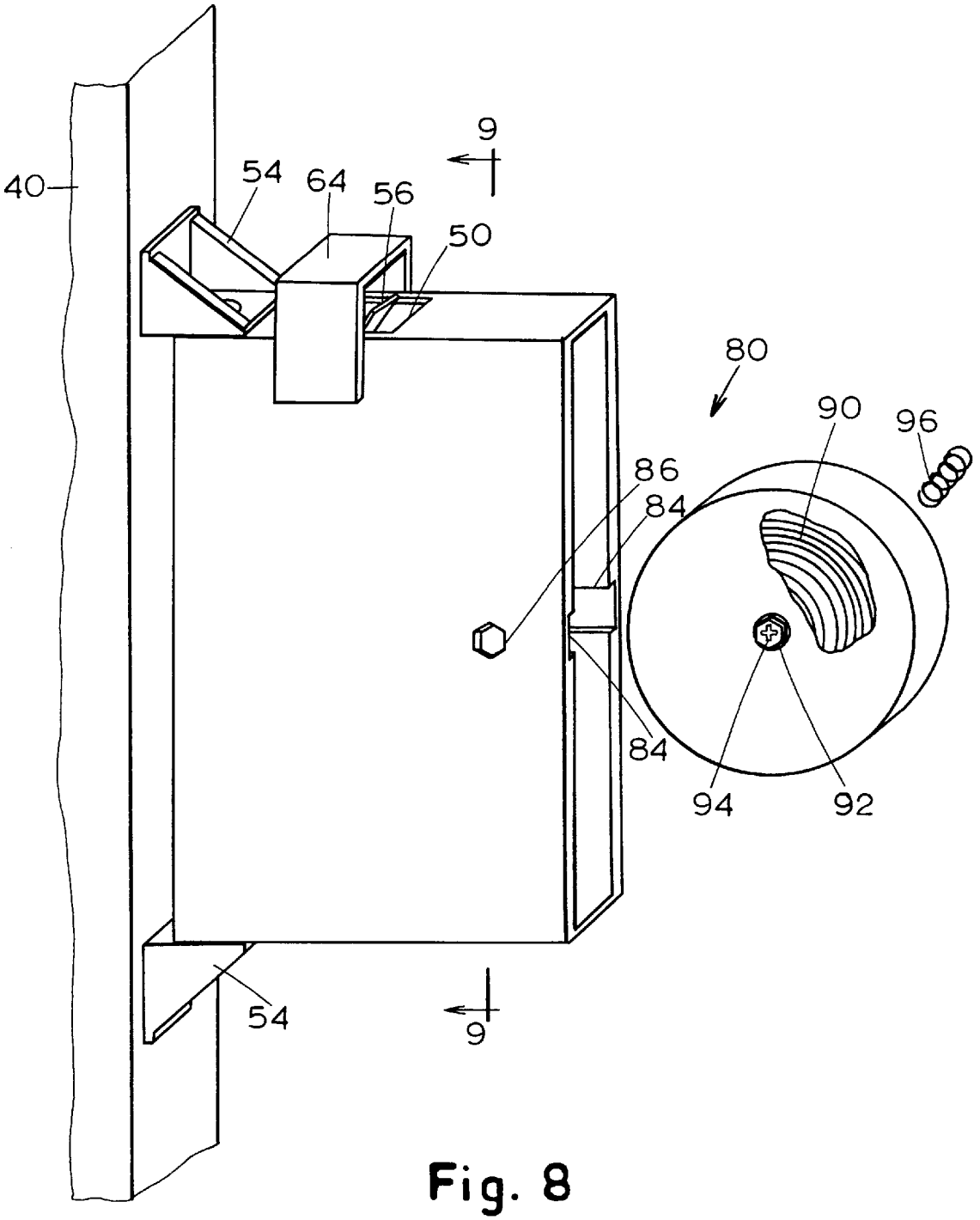
FIG. 8 is an exploded isometric view of an adjustable strap recoiler according to the present invention.
Figure 9:
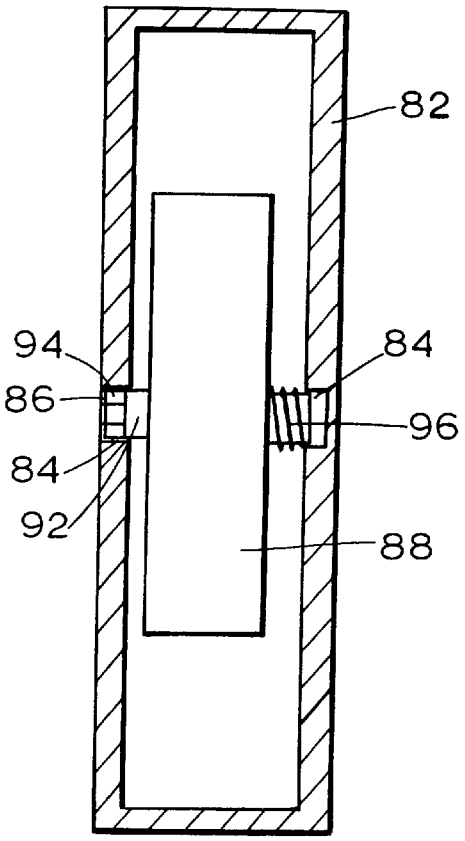
FIGS. 9 is a cross-sectional view taken through line 9–9 of the strap recoiler of FIG. 8 in the locked position.
Figure 10:
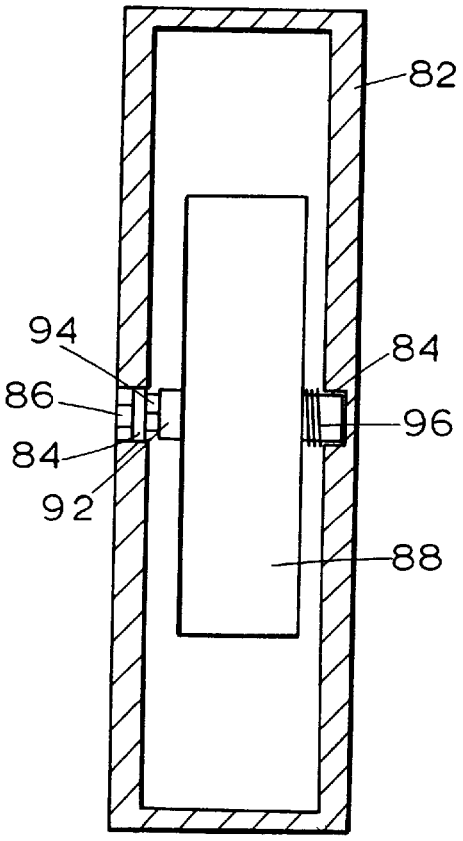
FIG. 10 is a cross-sectional view taken through line 9–9 of the strap recoiler of FIG. 8 in the unlocked position.

FIGS. 8–10 illustrate one embodiment of a strap recoiler 80 according to the present invention. Referring to FIG. 8, the disassembled strap recoiler 80 is shown with the strap 44 and the front portion of the strap recoiler 80 omitted for the sake of clarity. The strap recoiler 80 includes a housing 82 having a pair of interior channels 84. The housing 82 includes a hexagonal opening 86 through one wall and aligned with the corresponding channel 84. The channel 84 and opening 86 are dimensioned such that the width of the channel 84 is approximately equal to the distance across the opening 86 between opposite apices of the hexagon.

The strap recoiler 80 further includes a take-up roll 88 having an internal torsion spring 90 and a rotatable shaft 92. One end 94 of the shaft 92 is formed in the shape of a hexagon and is dimensioned slightly smaller than the hexagonal opening 86 in the housing 82. The hexagon-shaped end 94 of the shaft 92 further includes a groove adapted to receive the tip of a screw driver. Although the groove is shaped to receive a Phillips head screw driver, the groove may be configured to receive other tools that turn shafts, such as flat head screw drivers, Allen wrenches and ratchets. The opposite end of the shaft 92 (not shown in FIG. 8) extends through the take-up roll 88 and has a coil spring 96 disposed thereon.

The strap recoiler 80 is assembled by inserting the take-up roll 88 into the housing 82 with the ends of the shaft 92 disposed within the channels 84. The hexagonal end 94 of the shaft 92 is inserted into the channel 84 corresponding to the opening 86 in housing 82. The opposite end of the shaft 92 is inserted into the opposite channel 84 with the spring 96 disposed between the take-up roll 88 and the inner wall of the housing 82. The take-up roll 88 is inserted into the housing 82 until the hexagonal end 94 of the shaft 92 reaches the opening 86. Once inserted, the take-up roll 88 is rotated until the end 94 aligns with the opening 86 and the force of the spring 96 forces the end 94 into the opening 86. In this position, the opening 86 engages the end 94 of the shaft 92 to prevent rotation of the shaft 92 when the take-up roll rotates to roll and unroll the strap 44.

During normal operation of the shutter assembly, the take-up roll 88 is in the position shown in FIG. 9. The coil spring 96 bears upon the take-up roll 88 and the inner wall of the housing 82 to keep the hexagonal end 94 within the opening 86. The ends of the shaft 92 are disposed within the channels 84 to hold the take-up roll in place as the strap 44 is rolled and unrolled.

The strap recoiler 80 according to the present invention allows the tension in the torsion spring 90 to be adjusted without disassembling the housing 82 or the shutter housing. To adjust the tension, a tool is inserted into the groove in the hexagonal end 94 of the shaft 92 and an axial force is exerted on the shaft 92 to move the take-up roll 88 to the position shown in FIG. 10. The axial force on the shaft 92 causes the coil spring 96 to compress. The hexagonal end 94 is pushed through the opening 86 and into the channel 84. Once the end 94 has cleared the opening 86, the shaft 92 is free to rotate as a force is exerted to rotate the engaging tool. As the shaft 92 is turned and the take-up roll 88 remains stationary, the tension in the torsion spring 90 is adjusted.

After the torsion spring 90 is adjusted to the desired tension, the hexagonal end 94 is realigned with the opening 86. As the axial force is removed from the shaft 92, the coil spring 96 biases the end 94 of the shaft 92 into the opening 86 in the position shown in FIG. 9. When the hexagonal end 94 is again disposed within the opening 86, the shaft 92 is locked in place and ready for normal operation of the shutter assembly.

Figure 11:
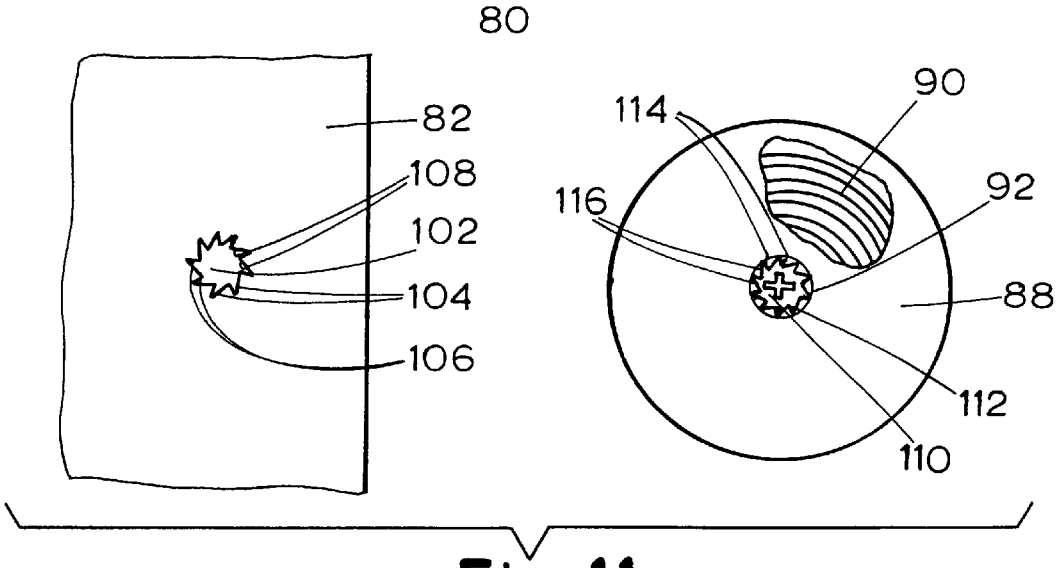
FIG. 11 is an exploded partial side view of an alternative embodiment of an adjustable strap recoiler according to the present invention.

Although the embodiment shown herein includes a hexagonal opening 86, a hexagonal end 94 on the shaft 92, and a coil spring 96, other configurations will be apparent to those skilled in the art. For example, the torsion spring 90 is almost always adjusted to increase the tension due to fatigue in the metal. For this reason, the opening 86 and end 94 of the shaft 92 could have a ratchet and pawl-type configuration, such as that shown in FIG. 11, to allow rotation of the shaft 92 in the direction that increases the tension in the torsion spring 90 and to prevent rotation of the shaft 92 in the opposite direction. In the embodiment of FIG. 11, the housing 82 includes an opening 102 formed with a plurality of inwardly-extending detents 104. The detents 104 are wedge-shaped and have a locking surface 106 and a thrust surface 108. The shaft 92 has an end 110 formed with a plurality of outwardly-extending wedges 112 having locking surfaces 114 and thrust surfaces 116 that correspond to the locking surfaces 106 and thrust surfaces 108 of the detents 104. The end 110 further includes a groove adapted to receive a tool that applies a torque to the shaft 92.

When the strap recoiler 80 is assembled, the end 110 of the shaft 92 is inserted into the opening 102 with the wedges 112 aligned between the detents 104. In this position, the locking surfaces 106 of the opening 102 engage the corresponding locking surfaces 114 of the end 110 of the shaft 92 to prevent clockwise rotation of the shaft 92. Either the housing 82, the shaft 92, or both are formed from a material with a resiliency that allows the detents 104, the wedges 112, or both, to deflect when a torque is applied to the shaft 92 in the counter-clockwise direction. As the torque is applied, a force is exerted between the thrust surfaces 116 of the shaft 92 and the corresponding thrust surfaces 108 of the opening 102. The resilient material allows the detents 104 and/or the wedges 112 to deflect as the torque is applied, thereby facilitating counter-clockwise rotation of the shaft 92. Once the thrust surfaces 116 of the wedges 112 have cleared the thrust surfaces 108 of the detents 104, the deflected components return to their initial positions so that the corresponding locking surfaces 106, 114 engage to prevent clockwise rotation of the shaft 92 under the increased torque exerted by the torsion spring 90.

Additional configurations that allow for adjustment of the torsion spring 90 without disassembling the strap recoiler 90 are contemplated by the inventor as having use with the present invention. For example, one alternative ratchet-and-pawl arrangement could include a circular opening in the housing and an internal pawl on the interior of the housing. The pawl may be integrally formed with the housing or a separate component fastened to the housing wall during assembly. The end of the shaft would further include a ratchet wheel engaged by the pawl to prevent rotation in one direction while allowing rotation in the opposite direction to increase the tension in the torsion spring.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A strap recoiler for a rolling shutter assembly, comprising:

a housing having an opening in a top wall thereof;

a take-up roll rotatably mounted within said housing and having a torsion spring adapted to bias said take-up roll to rotate in a first direction;

a strap having a first end coupled to said take-up roll and a second end extending through said opening in said housing, said strap rolling up on said take-up roll when said take-up roll rotates in said first direction and unrolling from said take-up roll when said take-up roll rotates in a second direction;

a locking mechanism disposed within said housing proximate said opening and having a locked position wherein said strap is engaged by said locking mechanism to prevent said strap from unrolling from said take-up roll and an unlocked position wherein said locking mechanism disengages said strap to allow said strap to unroll from said take-up roll; and a cover disposed over said opening and said locking mechanism, said cover being adapted to prevent engagement of said locking mechanism to move said locking mechanism from said locked position and said unlocked position.

2. A strap recoiler according to claim 1, wherein said locking mechanism comprises:

a brake tab pivotally mounted to said housing; and a pin mounted to said housing, wherein said strap is disposed between said brake tab and said pin and said brake tab pivots between said locked position wherein said brake tab engages said strap and said pin to prevent said strap from unrolling from take-up roll and said unlocked position wherein said brake tab does not engage said strap and said pin to prevent said strap from unrolling from said take-up roll.

3. A strap recoiler according to claim 1, wherein said cover is mounted on said housing.

4. A strap recoiler according to claim 1, wherein said housing and said cover are integrally formed as a single component.

5. A strap recoiler according to claim 1, further comprising a mounting bracket pivotally mounted to said housing and rigidly mounted to said rolling shutter assembly.

6. A strap recoiler for a rolling shutter assembly, comprising:

a housing having a first opening in a side wall thereof and a second opening in a top wall thereof;

a shaft disposed within said housing and having a first end disposed within said first opening, wherein said first opening is adapted to engage said first end of said shaft to prevent rotation in at least one direction;

a take-up roll disposed within said housing and rotatably mounted on said shaft;

a torsion spring having a first end coupled to said take-up roll and a second end coupled to said shaft;

a strap having a first end coupled to said take-up roll and a second end extending through said second opening in said housing, wherein said strap rolls up on said take-up roll when said take-up roll rotates in a first direction and unrolls from said take-up roll when said take-up roll rotates in a second direction, and wherein said torsion spring is adapted to bias said take-up roll to rotate in said first direction;

a locking mechanism disposed within said housing proximate said opening and having a locked position wherein said strap is engaged by said locking mechanism to prevent said strap from unrolling from said take-up roll and an unlocked position wherein said locking mechanism disengages said strap to allow said strap to unroll from said take-up roll;

said first opening and said shaft being adapted to allow rotation of said shaft relative to said take-up roll when a torque is applied to said shaft without removing said shaft, said take-up roll and said torsion spring from said housing.

7. A strap recoiler according to claim 6, wherein said first opening engages said first end to allow rotation of said shaft in a direction that increases said biasing of said torsion spring to rotate said take-up roll in said first direction.

8. A strap recoiler according to claim 7, wherein said first opening includes a detent and said first end includes an engagement member, whereby said detent engages said engagement member to prevent rotation of said shaft in a direction that decreases said biasing of said torsion spring to rotate said take-up roll in said first direction, and whereby said detent and said engagement member are adapted to allow rotation of said shaft in said direction that increases said biasing of said torsion spring to rotate said take-up roll in said first direction.

9. A strap recoiler according to claims 8, wherein said first opening includes a plurality of detents and said first end includes a plurality of engagement members.

10. A strap recoiler according to claim 7, wherein said housing further includes a pawl mounted proximate said first opening and said first end includes an engagement member, whereby said pawl engages said engagement member to prevent rotation of said shaft in a direction that decreases said biasing of said torsion spring to rotate said take-up roll in said first direction, and whereby said pawl and said engagement member are adapted to allow rotation of said shaft in said direction that increases said biasing of said torsion spring to rotate said take-up roll in said first direction.

11. A strap recoiler according to claim 6, wherein said first opening engages said first end to prevent rotation of said shaft, said strap recoiler further comprising a coil spring disposed within said housing and biasing said first end of said shaft into engagement with said first opening.

12. A strap recoiler according to claim 11, wherein said shaft is free to rotate in either direction when an axial force is applied to said first end of said shaft against the biasing of said coil spring to disengage said first end from said first opening, and wherein said coil spring biases said first end into engagement with said first hole when the axial force is removed.

* * * * *